US005882735A

United States Patent [19]

Takeuchi

[11] Patent Number: 5,882,735

[45] Date of Patent: Mar. 16, 1999

[54] METHOD FOR FEEDING OF COATING

[75] Inventor: Tohru Takeuchi, Yokohama, Japan

[73] Assignee: Kansai Paint Co., Ltd., Hyogo, Japan

[21] Appl. No.: 767,061

[22] Filed: Dec. 16, 1996

[30] Foreign Application Priority Data

Dec. 19, 1995 [JP] Japan ..... 7-330144

[51] Int. Cl.[6] ..... B05D 1/18

[52] U.S. Cl. ..... 427/430.1; 222/95; 222/327; 427/421; 427/424

[58] Field of Search ..... 427/421, 424, 427/430.1; 222/95, 327

[56] References Cited

U.S. PATENT DOCUMENTS

| | | | |
|---|---|---|---|
| 3,884,396 | 5/1975 | Gordon et al. | 222/327 |
| 4,312,091 | 1/1982 | Cardus | 15/97 A |
| 4,373,646 | 2/1983 | MacEwen | 222/327 |
| 4,432,473 | 2/1984 | MacEwen | 222/327 |
| 4,985,283 | 1/1991 | Ogata et al. | 427/424 |

*Primary Examiner*—Bernard Pianalto
*Attorney, Agent, or Firm*—Wenderoth, Lind & Ponack, L.L.P.

[57] ABSTRACT

The present invention provides:

a method for the feeding of a coating, which comprises:

(1) a step of fitting a cartridge filled with a predetermined coating, to an automatic coating device or an apparatus capable of feeding a coating to an automatic coating device, and (2) applying an external pressure to the fitted cartridge to feed the coating in the cartridge, to a coating gun; and a method for the application of a top coating onto an automobile body, which comprises applying, onto an automobile body which is a material to be coated, a top coating fed to a coating gun by the above-mentioned method for feeding of coating.

5 Claims, 3 Drawing Sheets

METHOD FOR FEEDING OF COATING

FIELD OF THE INVENTION

The present invention relates to a method for the feeding of a coating, capable of easily feeding a coating of any desired color, as well as to a method for application of a top coating onto an automobile body using said method for feeding of a coating.

BACKGROUND OF THE INVENTION

In automobile manufacture, several to several tens of coating colors are used in application of top coatings onto automobile bodies of different vehicle types or models, and coating pipes corresponding to the number of coating colors used are provided at each coating line. Since these pipes extend several hundred meters, in some cases, from coating storage tanks to a coating booth via a circulating device, the initial investment cost for coating line and the maintenance cost thereof are very large and become even larger with an increase in number of coating colors. Moreover, the coating colors are generally changed to new colors at the time of each full or minor model change of automobile body.

Of automobile bodies, those of commercial vehicles (e.g. trucks and vans), in particular, generally have requirements different from those of other vehicles because of their application purposes; in order to satisfy the requirements of individual vehicle types, their coating is conducted in a coating mode for vehicle production of many kinds each of small production amount and, in an extreme case, a coating mode of different coating to each automobile is employed. However, it has been very difficult for automobile makers to feed coatings of all required colors (including colors of extremely low use amounts) according to conventional methods. Therefore, when the coating mode of different coating to each automobile is necessary, such coating has often been conducted at subcontractors. This coating at subcontractors has incurred a very high cost as compared with efficient line coating, because of (1) the transfer cost of vehicle between automobile maker and subcontractor and (2) extra cost associated with coating, required at subcontractor.

SUMMARY OF THE INVENTION

The present inventor made a study in order to develop a method for feeding of coating, capable of effectively conducting coating for vehicle production of many kinds each of small production cost, for example, different coating to each automobile. As a result, the present inventor found that by using a coating-filled cartridge in combination with an automatic coating device, a coating of any desired color can be fed easily and thereby coating for vehicle production of many kinds each of small production amount can be conducted effectively. The present invention has been completed based on this finding.

The present invention provides a method for the feeding of a coating, which comprises:

(1) a step of fitting a cartridge filled with a predetermined coating, to an automatic coating device or an apparatus capable of feeding a coating to an automatic coating device, and (2) applying an external pressure to the fitted cartridge to feed the coating in the cartridge, to a coating gun.

The present invention further provides a method for the application of a top coating onto an automobile body, which comprises applying, onto an automobile body which is a material to be coated, a top coating fed to a coating gun by the above-mentioned method for feeding of coating.

In the present invention, the coating used by being filled in a cartridge is a liquid coating of predetermined color, to be coated on a material to be coated, and may be any of organic solvent type or an aqueous type. This liquid coating of predetermined color has no restriction as to the production method and can be obtained, for example, by mixing a plurality of mass color-coatings so as to give a predetermined color and subjecting the mixture to viscosity adjustment. In this case, the predetermined color can be achieved by appropriately using metering, the skill of experienced engineer, a combination thereof or the like.

The cartridge used for filling of the above coating must not be dissolved by the solvent contained in the coating, etc. and must have a sufficient resistance to the coating. The material for the cartridge can be polyethylene, polypropylene, nylon, teflon, aluminum, a two or more layer laminate thereof, etc.

DETAILED DESCRIPTION OF THE INVENTION

The method for the feeding of a coating according to the present invention is hereinafter described with reference to the accompanying drawings.

Figure 1A:
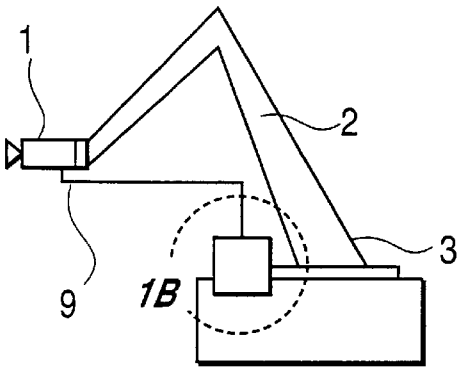
FIG. 1 is a drawing showing an example of the method for feeding of coating according to the present invention.
Figure 1B:
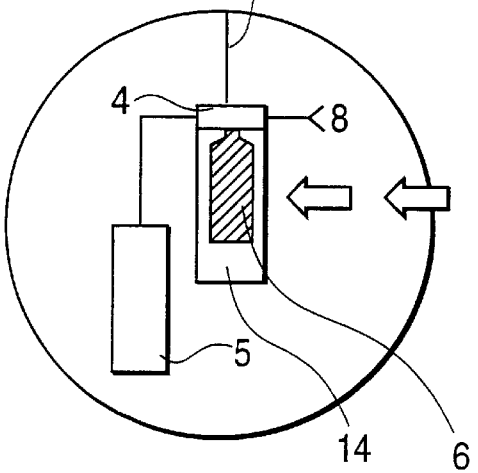
Figure 1C:
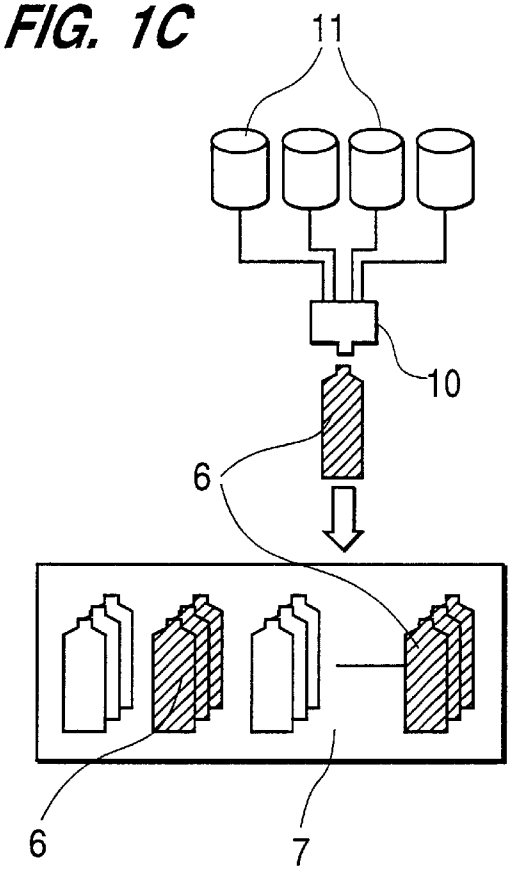
Figure 2A:
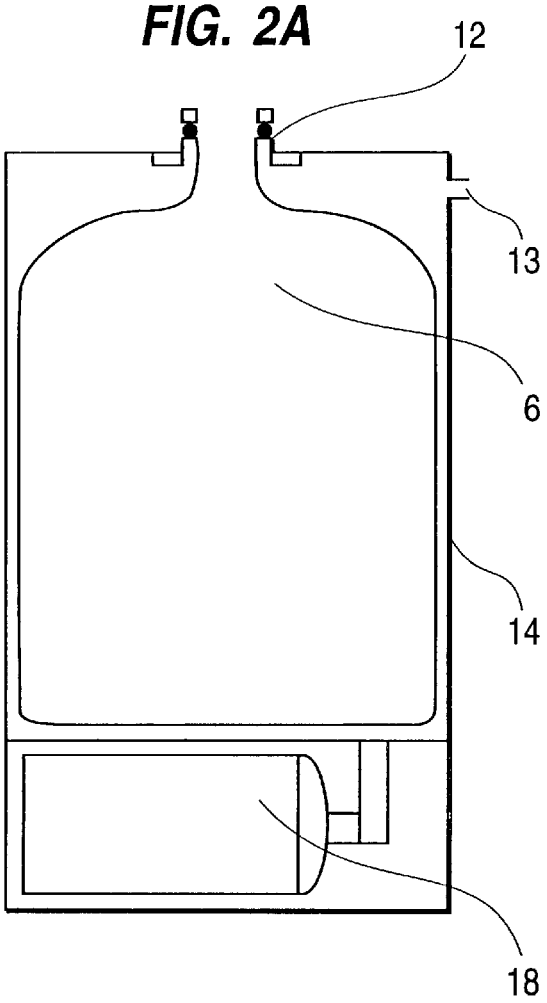
FIG. 2 is a schematic drawing showing an example of the mechanism of a cartridge and a cartridge holder used in the method for feeding of coating according to the present invention.
Figure 2B:
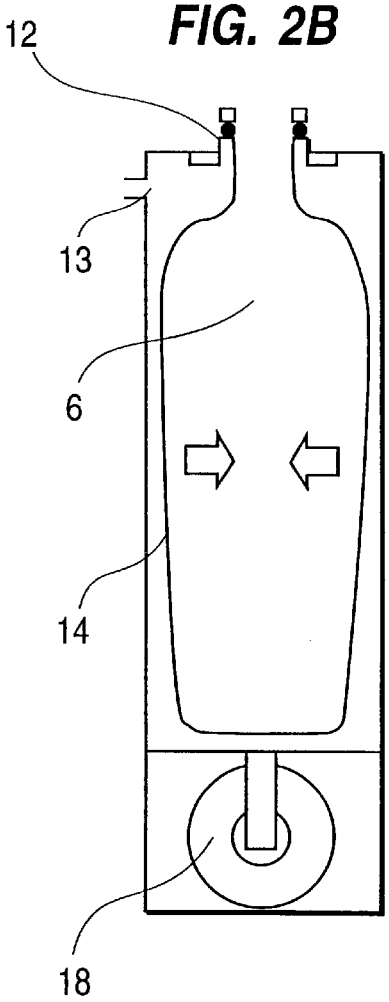

FIG. 1 is a drawing showing an example of the method for the feeding of a coating according to the present invention; and FIG. 2 is a schematic drawing showing an example of the mechanism of a cartridge and a cartridge holder used in the method for the feeding of a coating according to the present invention.

In FIG. 1, a predetermined coating can be produced by compounding a plurality of mass color-coatings stored in tanks 11, by the use of an automatic metering system 10 ("Accutinter", a product of Miller Co. of U.S.), according to the program prepared before-hand based on inputted data such as desired color and the like and, as necessary, adding a solvent, etc. During the coating production, it is preferable to conduct viscosity adjustment. Fine color adjustment may be conducted after the color matching by automatic metering.

The predetermined coating obtained above is filled in a cartridge, whereby a cartridge 6 filled with the predetermined coating is obtained. This cartridge is a special molding made of teflon and has such flexibility that it shrinks upon application of an external pressure, for example, a gas (e.g. air, carbon dioxide or flon) pressure. The volume of the cartridge has no particular restriction and can be appropriately determined depending upon the size of material to be coated, the thickness of coating film, etc. but, when the coating in the cartridge is used for surface coating of automobile body, is generally about 0.5–1 liter.

The cartridge 6 filled with the predetermined coating is stored in a cartridge chamber 7. In the cartridge chamber 7 are also stored cartridges filled with coatings of other colors scheduled to be used. In the present invention, storage of the cartridge 6 in the cartridge chamber 7 is not requisite but is preferred to make smooth the system flow to the next step.

In FIG. 1, the cartridge chamber 7 is provided very close to the operating territory of an automatic coating device 2 (a coating robot). The automatic coating device 2, when a signal for charging is inputted therein, selects and takes out the cartridge 6 filled with a coating of required color and charges it into a cartridge holder 14, in accordance with the operational program inputted beforehand (taking-out and charging of cartridge may be conducted manually).

The cartridge 6 charged in the cartridge holder 14 is connected, by a quick joint 12 shown in FIG. 2, to a color change valve 4 capable of feeding air sent from an air-for-cleaning generator 8 and a thinner sent from a thinner-for-cleaning tank 5.

In FIG. 2, the inside of the cartridge holder 14 is designed so as to assume a sealed state when the cartridge 6 is accommodated therein and connected to the color change valve 4 shown in FIG. 1, and receives a predetermined gas pressure given by a compressed gas bomb 18 accommodated in the cartridge holder 14 at the bottom, via a regulator (not shown). The compressed gas bomb 18 may be replaced by a compressor provided outside the cartridge holder 14, and compressed air may be sent into the cartridge holder 14 from the compressor to apply a gas pressure to the cartridge 6. The cartridge holder 14 is provided with a relief valve 13 so that the holder inside can assume atmospheric pressure when the cartridge is not in use or is detached.

By a stand-by signal for start of coating, the valve (not shown) of the compressed gas bomb 18 is opened, and a predetermined gas pressure is applied to the cartridge 6, whereby the cartridge 6 shrinks as shown by arrow marks. As a result, the coating in the cartridge 6 is pushed out and arrives at the coating on/off valve (not shown) accommodated in a coating gun 1, via the color change valve 4 and a paint tube 9, whereby a coating path is filled quickly. Coating is completed in accordance with a predetermined coating program. Preferably, control is made so that during coating, a coating is quantitatively discharged to the coating gun.

After the completion of coating, the cartridge 6 after use is taken out from the cartridge holder 14 and returned to the receiver (not shown) for cartridge to be regenerated, provided in the cartridge chamber 7. Preferably, the cartridge 6 after use is filled again with a coating of the same color as that of the used coating. The cartridge 6 after use may be discarded.

After the completion of coating, the coating path from the color change valve 4 to the coating gun 1 is cleaned to enable the use of a coating of a different color therethrough. The method for cleaning is not particularly restricted and the cleaning can be conducted appropriately. The cleaning can be made effectively, for example, by pushing out the coating remaining in the coating path, by the use of the air fed from the air-for-cleaning generator 8, discharging a thinner from the thinner-for-cleaning tank 5, and repeating the air/thinner discharging.

Figure 3A:
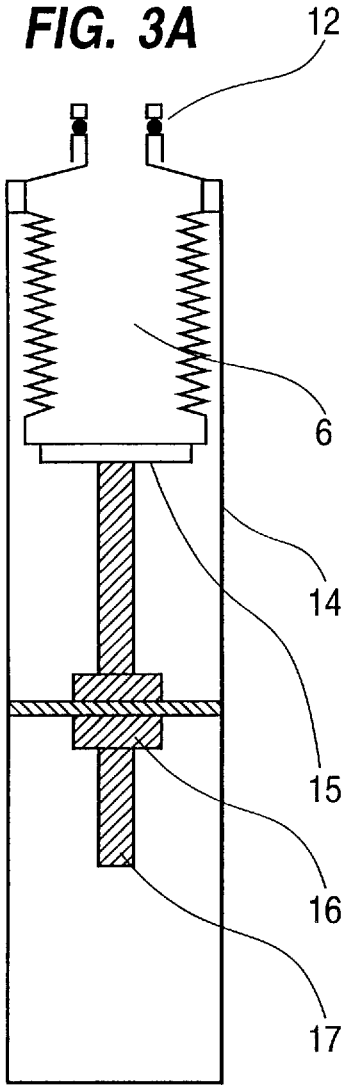
FIG. 3 is a schematic sectional drawing showing the states of cartridge before and after shrinkage, in an example of the mechanism of a cartridge and a cartridge holder used in the method for feeding of coating according to the present invention.
Figure 3B:
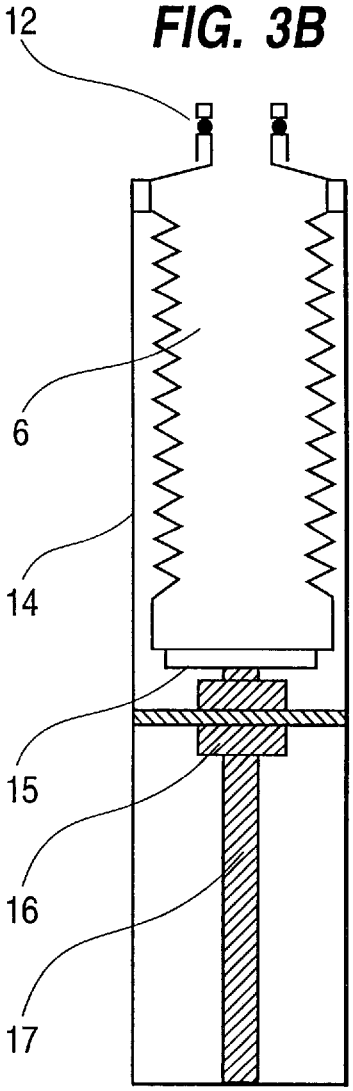

FIG. 3 is a schematic sectional drawing showing the states of cartridge before and after shrinkage, in another example of the mechanism of a cartridge and a cartridge holder used in the method for the feeding of a coating according to the present invention.

The cartridge 6 is specially made so as to be able to shrink in the vertical direction. To a cartridge holder 14 is fitted a piston pad 15 which can be abutted to the bottom of the cartridge 6 to uniformly press up or press down the bottom of the cartridge 6. The piston pad 15 is connected to a ball thread which can be rotated and moved upward or downward by the drive of a servo motor 16 accommodated in the cartridge holder 14. Upward movement of the ball thread moves the piston pad 15 upward, which in turn shrinks the cartridge 6. Rotation of the servo motor 16 at a constant speed enables quantitative and accurate discharging of a coating form the cartridge 6.

Next, description is made on the method for application of top coating onto an automobile body according to the present invention.

An automobile body on which a top coating is to be applied, generally comprises a substrate (e.g. a metal), a primer film (e.g. an electrocoating film) formed thereon and, as necessary, an intermediate coating film formed on the primer film. Onto these coating films are applied a top coating fed to the coating gun by the above-mentioned method for feeding of coating. The top coating is preferably a known top coating for use in automobiles.

The top coating film can be constituted by any of the known top coating films such as colored enamel coating film, colored base coating film-clear coating film, metallic base coating film-clear coating film, colored base coating film-metallic base coating film-clear coating film, and the like.

The method for the feeding of a coating according to the present invention can be preferably employed not only in top coating of an automobile body but also in line-or on-site-coating for automobile production of many kinds each of small production amount.

The present method for the feeding of a coating makes it unnecessary to use any facility for circulation of coating as required in conventional methods; can easily respond to increase or decrease in number of coating colors; and moreover can easily respond to users' requests (which are believed to increase in the future) for automobile production of many kinds each of small production amount. Further in the present method for the feeding of a coating, the cartridges can be prepared in a number just necessary for automobile production schedule and each cartridge can be used up; therefore, even in the cartridge(s) of coating color of very low use amount, there can be eliminated inconveniences (e.g. inferior coating) caused by quality deterioration, discoloration and the like, which have been experienced with conventional circulation facilities.

Further, the present method for the feeding of a coating requires only a small space for facility and accordingly can preferably be applied not only to automobile production lines but also to coating lines for automobile production of many kinds each of small production amount. Furthermore, the present method enables automated feeding of coating. Moreover, the present method, as compared with conventional facilities for coating circulation, can easily conduct after-coating cleaning and coating change to different color, and thereby can reduce the amount of washings.

What is claimed is:

1. A method for the feeding of a coating, which comprises:

(1) a step of fitting a cartridge which is filled with a predetermined coating and which is shrinkable by application of an external gas pressure, to an automatic coating device or an apparatus capable of feeding a coating to an automatic coating device, and (2) applying an external gas pressure to the outer surface of the fitted cartridge to cause the coating in the cartridge to be fed to a coating gun.

2. A method according to claim 1, wherein in the step (1), the fitting of the cartridge filled with a predetermined coating is conducted after the cartridge is selected from a plurality of cartridges each filled with a different coating and placed in a cartridge chamber.

3. A method according to claim 1, wherein an external gas pressure is applied to the cartridge in such a manner that the cartridge-inside volume is shrunken at a constant rate, to quantitatively feed the coating in the cartridge to the coating gun.

4. A method according to any one of claims 1, 2 and 3, wherein the predetermined coating filled in the cartridge is a coating obtained by mixing a plurality of mass color-coatings so as to give an intended color and subjecting the mixture to viscosity adjustment.

5. A method for the application of a top coating onto a body, which comprises applying, onto an automobile body which is a material to be coated, a top coating fed to a coating gun by the method for feeding of coating, set forth in claim 1.

* * * * *